US007552551B2

(12) United States Patent
Kohutko

(10) Patent No.: US 7,552,551 B2
(45) Date of Patent: Jun. 30, 2009

(54) SUCTION HEAD FOR SEDIMENT DREDGE

(76) Inventor: Richard J. Kohutko, N9397 Seventh Ave. South, Necedah, WI (US) 54646

( * ) Notice: Subject to any disclaimer, the term of this patent is extended or adjusted under 35 U.S.C. 154(b) by 494 days.

(21) Appl. No.: 11/302,354

(22) Filed: Dec. 12, 2005

(65) Prior Publication Data

US 2007/0130807 A1 Jun. 14, 2007

(51) Int. Cl.
*E02F 3/00* (2006.01)

(52) U.S. Cl. ..... 37/341; 37/318; 37/317; 37/335

(58) Field of Classification Search ..... 37/341, 37/318, 314, 316, 317, 319, 335
See application file for complete search history.

(56) References Cited

U.S. PATENT DOCUMENTS

| | | | | | |
|---|---|---|---|---|---|
| 216,061 | A * | 6/1879 | Shaw | 37/318 |
| 307,326 | A * | 10/1884 | Pattison | 15/1.7 |
| 371,686 | A * | 10/1887 | Howell | 37/333 |
| 1,101,541 | A * | 6/1914 | Harrington | 15/1.7 |
| 1,508,521 | A * | 9/1924 | Kreuser | 37/318 |
| 1,964,951 | A * | 7/1934 | Kertzman | 37/318 |
| 2,023,686 | A * | 12/1935 | Kertzman | 37/318 |
| 2,081,597 | A * | 5/1937 | Nowak | 15/1.7 |
| 2,643,471 | A * | 6/1953 | Ragsdale | 37/324 |
| 3,287,755 | A * | 11/1966 | Pansini | 15/1.7 |
| 4,113,616 | A | 9/1978 | Kaes | |
| 4,178,704 | A * | 12/1979 | Latimer et al. | 37/318 |
| 4,318,233 | A * | 3/1982 | Romain | 37/318 |
| 4,347,675 | A | 9/1982 | Latimer | |
| 4,352,251 | A * | 10/1982 | Sloan | 37/323 |
| 4,765,071 | A * | 8/1988 | Maitlen | 37/325 |
| 4,819,346 | A * | 4/1989 | Maitlen | 37/325 |
| 4,957,622 | A * | 9/1990 | Mims | 210/170.04 |
| 5,651,200 | A * | 7/1997 | Walsh et al. | 37/329 |
| 6,083,063 | A * | 7/2000 | Neisen | 440/46 |
| 6,283,805 | B1 * | 9/2001 | Ishigaki | 440/46 |
| 6,482,055 | B1 * | 11/2002 | Freitag | 440/46 |
| 2004/0010867 | A1 | 1/2004 | Habit et al. | |

* cited by examiner

*Primary Examiner*—Thomas A Beach
*Assistant Examiner*—Matthew R Buck
(74) *Attorney, Agent, or Firm*—Thomas J. Connelly; Wilhelm Law Service

(57) ABSTRACT

Dredge heads, for use with a dredging system, include one or more movable members, e.g. grate members, adapted and configured to selectively extend across the opening of the dredge head. The movable member(s) enables a user to clear the dredge head of plugging masses or blockages without having to de-energize the dredge system pump. Also, the movable member(s) enable a user to clear the dredge head of plugging masses or blockages without requiring the user to manually, by using his or her hand, withdraw the plugging masses or blockages from the opening of the suction/dredge heads.

27 Claims, 5 Drawing Sheets

SUCTION HEAD FOR SEDIMENT DREDGE

BACKGROUND

The present invention relates generally to sediment removal systems which are used in environmental clean-up of sediment in bodies of water such as lakes, ponds, rivers, etc. In particular, the present invention relates to apparatus located at terminal ends of such sediment removal systems, e.g. suction heads or dredge heads.

In general, sediment removal systems use suction pumps connected to suction heads or dredge heads by pipes, which are typically flexible hoses or other flexible, hollow, conduit-type members. SCUBA or other underwater divers can go underwater and manually move the suction/dredge heads about the bottom of the body of water, visually determining what material needs to be removed.

In order to remove sediment, the suction head is placed close enough to the sediment that the vacuum or suction force of the system draws the sediment into the and through the suction/dredge head, and into and through the connecting lines of hose.

As the sediment is drawn into the sediment removal system, the system vacuum force is not selective in drawing material into the suction/dredge head, and thence through the hoses. Thus, a certain amount of unwanted material is drawn into the sediment removal system along with the sediment which is desiredly being removed. The unwanted material can include stones and rocks, as well as a certain amount of organic vegetation.

Sediment removal systems are typically designed to remove smaller-size particles, such as sand, silt, sludge, muck, and the like, and so the equipment is designed to handle such smaller size particles. In the interest of efficiency of the system in handling such smaller size particles, the system is not designed primarily to handle larger stones and rocks. Thus, when a larger stone or rock gets into the system, the system can be damaged by the larger stone or rock. For example, a stone or rock can damage the impellers in a pump so that the efficacy of the pump is negated or severely degraded. Accordingly, certain steps have been taken to protect the moving parts of the system.

As one example, various filtering mechanisms have been employed, which are placed between the suction/dredge head and the pump. However, on occasion, various stones, rocks, and other relatively larger non-desired pieces of debris become lodged elsewhere in the system, such as in the hose between the filter and the suction/dredge head or at the dredge head opening.

Accordingly, efforts have been made to provide a filter mechanism at the suction/dredge head. Typical suction/dredge head filter mechanisms include one or more bars or a screen which is fixedly attached to the suction/dredge head. And one known suction/dredge head uses a hinged bar that covers part of the opening into the suction/dredge head.

However, all such previous filter mechanisms at the suction/dredge head have proved inadequate. The filter mechanisms, which include fixed bars or screens, plug with various particles and objects, whereby the user has to, with his or her hand, pull such particles and objects out of or away from the fixed bars or screens. Since the suction power generated by the pump can be substantial, the user, for safety and/or other reasons, must first de-energize the pump prior to removing the plugged particles and objects from the suction/dredge head.

The filter mechanisms which include a hinged bar have proven inadequate for the intended purpose of use for numerous reasons. As one example, the bar hingedly travels only a relatively short distance, whereby when hinged fully open, portions of the bar are relatively further from the opening of the suction/dredge head, yet the bar continues to extend over a column projected from the opening. Accordingly, when the bar is hingedly opened, and particles or objects communicating with the bar remain substantially in-line with the pull of the vacuum, whereby when the bar is hingedly opened, the particles or objects can of roll, slide, or otherwise deflect off the bar, into the path of vacuum pull, thence non-desiredly into and through the suction/dredge head.

As another example, filter mechanisms which include a hinged bar have proven inadequate because the hinged connection between the bar and the suction/dredge head is substantially loose which provides a substantial amount of free-play at the bar. Accordingly, the bar easily flops, droops, sags, hangs down, wobbles, and or otherwise non-desiredly freely moves. Because of this loose connection, the bar is easily displaced from the desired location across the opening of the suction/dredge head.

When the bar is at an extreme positions of displacement, the bar extend across a minor portion or very little of the opening, whereby the effective size of the opening, e.g. the largest unobstructed portion of the opening, remains sufficiently close to that of the opening without the bar extending there across, such that various non-desired particles and objects can still pass through the opening, into and through the suction/dredge head, and non-desiredly into various other portions of the system. In other words, when the bar is at an extreme position of displacement, the integrity of the filtering function provided by the bar is largely, and sometimes wholly, compromised, whereby the hinged bar substantially fails to provide the desired mechanical protection for the system.

Accordingly, it might prove desirable and/or beneficial to provide suction/dredge heads which can be cleared of plugging masses or blockages without having to de-energize the corresponding system pump.

It might prove beneficial to provide suction/dredge heads which include one or more movable members adapted and configured to clear plugging masses or blockages from the opening of the suction/dredge heads, without requiring the user to manually withdraw the plugging masses or blockages from the opening of the suction/dredge heads by using his or her hand.

It might prove beneficial to provide suction/dredge heads which include one or more movable members adapted and configured to clear plugging masses or blockages from the opening of the suction/dredge heads which are sufficiently stable so as to remain substantially static when the one or more movably members extends across the opening of the suction/dredge head, during use.

SUMMARY

The invention generally provides dredge heads, for use with a dredging system, which include one or more movable members, e.g. grate members, adapted and configured to selectively extend across the opening of the dredge head, as desired by a user. The movable member(s) enables a user to clear the dredge head of plugging masses or blockages without having to de-energize the dredge system pump. Also, the movable member(s) enable a user to clear the dredge head of plugging masses or blockages without requiring the user to manually withdraw the plugging masses or blockages from the opening of the suction/dredge heads by using his or her hand.

In a first family of embodiments, the invention comprehends a dredge head comprising: (a) a blade having a forward facing surface, a rearward facing surface, a thickness dimension, and an opening which extends through the thickness of the blade and defines a blade opening width dimension; (b) a header tube having a forward facing end, a rearward facing end, and an opening which extends axially between the forward and reward facing ends, through the header tube, the forward facing end of the header tube interfacing with the rearward facing end of the blade and the header tube opening and the blade opening generally coaxially aligned with each other; (c) a grate selectably extending across the blade opening and having an upper grate prong and a lower grate prong, the upper and lower grate prongs spaced from each other and defining an elongate slot therebetween, the grate movable between first and second positions, the grate in such first grate position extending across and communicating with the blade opening and the grate in such second grate position not extending across and communicating with the blade opening; and (d) an articulatable member movable between first and second positions and operably connected to the grate, the articulatable member in such first position corresponding to the grate in such first grate position and the articulatable member is such second position corresponding to the grate in such second grate position.

In some embodiments, the grate elongate slot defines a slot opening width dimension corresponding to the distance between the upper grate prong and a lower grate prong and a slot opening length dimension corresponding to the length dimension of ones of the upper grate prong and a lower grate prong, the magnitude of such slot length dimension greater than the magnitude of such slot width dimension.

In some embodiments, the grate is removably attached to ones of the blade and the head tube.

In some embodiments, the grate is generally planar.

In some embodiments, the grate is generally arcuate.

In some embodiments, the grate in such first grate position generally defines at least three openings which extend into the header tube opening.

In some embodiments, two of the at least three openings are generally hemispherical shaped openings and one of the at least three openings is a generally rectangular shaped opening.

In some embodiments, two of the at least three openings are generally crescent shaped openings and one of the at least three openings is a generally elliptical shaped opening.

In some embodiments, the dredge head is part of a dredging system.

In a second family of embodiments, the invention comprehends a dredge head comprising: (a) a blade having a forward facing surface a rearward facing surface, a thickness dimension, and an opening which extends through the thickness of the blade and defines a blade opening width dimension; (b) a header tube having a forward facing end, a rearward facing end, and an opening which extends axially between the forward and reward facing ends, through the header tube, the forward facing end of the header tube interfacing with the rearward facing end of the blade and the header tube opening and the blade opening generally coaxially aligned with each other; and (c) a grate pivotably attached to ones of the blade and the header tube, the grate pivotably movable between first and second positions, the grate in such first grate position extending across the blade opening and the grate in such second grate position not extending across the blade opening, the grate pivotable about an axis of pivotation which is generally displaced from the blade.

In some embodiments, the axis of pivotation is displaced outwardly from the blade forward facing surface, with the blade forward facing surface facing the axis of pivotation.

In some embodiments, the axis of pivotation displaced outwardly from the blade, with the blade rearward facing surface facing the axis of pivotation.

In some embodiments, the axis of pivotation is a generally vertical axis of pivotation.

In some embodiments, the axis of pivotation is generally perpendicular to an axis which extends through the length of the header tube bore.

In a third family of embodiments, the invention comprehends a dredge head comprising: (a) a blade having a forward facing surface a rearward facing surface, a thickness dimension, and an opening which extends through the thickness of the blade and defines a blade opening width dimension; (b) a header tube having a forward facing end, a rearward facing end, and an opening which extends. axially through the header tube, the header tube forward facing end interfacing the rearward facing surface of the blade, the header tube having a first lateral surface and a second lateral surface; and (c) an elongate grate having an end and pivotably attached to ones of the blade and the header tube, adjacent the first header tube lateral surface, the grate pivotably movable between first and second positions wherein when the grate is in such first grate position, the end of the grate positioned laterally beyond a straight-line projected from the second header tube lateral surface; and when the grate is in such second grate position, the end of the grate positioned generally between a straight-line projected from the first header tube lateral surface and a straight-line projected from the second header tube lateral surface.

In some embodiments, when the grate is in such second grate position, the end of the grate positioned generally between a straight-line projected from the first header tube lateral surface and a straight-line projected from the second header tube lateral surface and proximate the first header tube lateral surface.

In a fourth family of embodiments the invention comprehends a dredge head comprising: (a) a blade having a forward facing surface a rearward facing surface, a thickness dimension, and an opening which extends through the thickness of the blade; (b) a header tube attached to the blade and having a forward facing end, a rearward facing end, and an opening which extends axially through the header tube, the forward facing end of the header tube proximate the blade and the rearward facing end of the header tube distal the blade; and (c) a grate pivotably attached to ones of the blade and the header tube, the grate pivotably movable between first and second positions, the grate in such first grate position proximate the blade opening and the grate in such second grate distal the blade opening, the grate pivotable about an axis of pivotation and along an angle of pivotation having a magnitude of greater than about 50 degrees of pivoting travel.

In some embodiments, the grate is pivotable about an axis of pivotation and along an angle of pivotation having a magnitude of greater than about 60 degrees of pivoting travel.

In some embodiments, the grate is pivotable about an axis of pivotation and along an angle of pivotation having a magnitude of greater than about 70 degrees of pivoting travel.

In some embodiments, the grate is pivotable about an axis of pivotation and along an angle of pivotation having a magnitude of greater than about 80 degrees of pivoting travel.

In some embodiments, the grate comprising a first elongate prong and a second elongate prong, the first and second prongs defining a void therebetween.

In some embodiments, the grate is removably attached to ones of the blade and the header tube.

Figure 1:
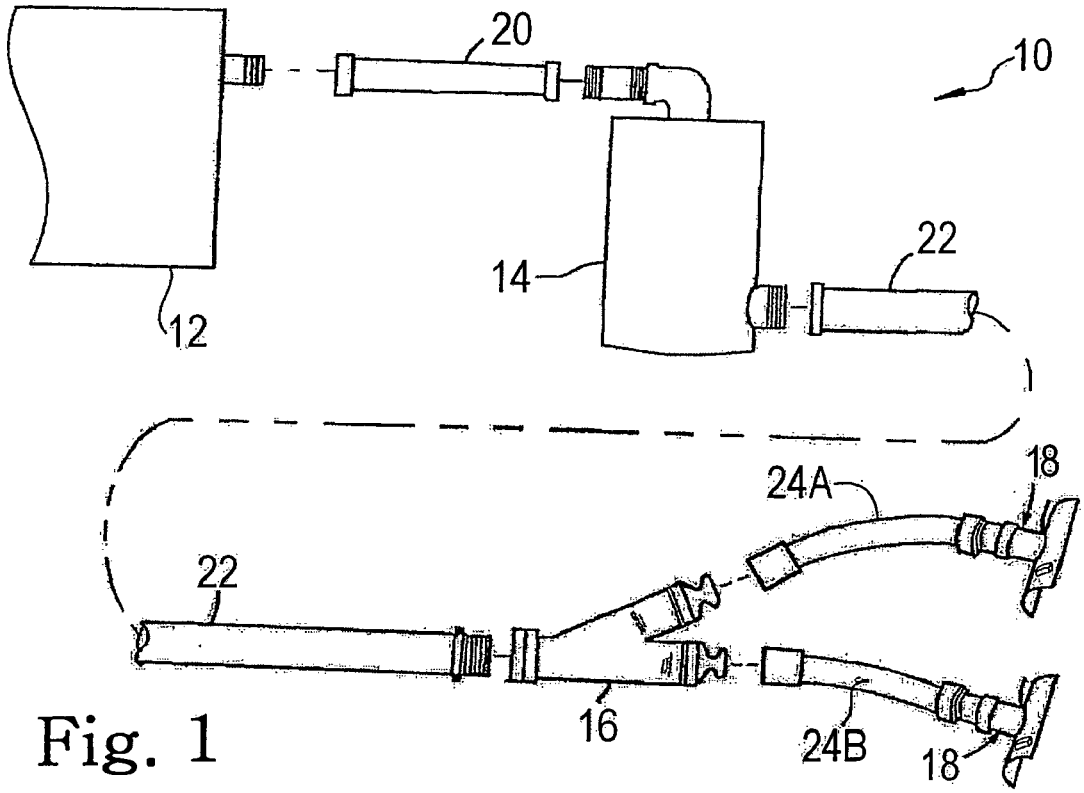
FIG. 1 shows a partially schematic, exploded view of a dredging system which includes two dredge heads of a first embodiment of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

FIG. 1 shows a dredging system, i.e. dredging system 10, which includes pump 12, gravity filter 14, Y-connector 16, one or more dredge heads 18, and various hoses such as hoses 20, 22, 24A, 24B. Dredging system 10 is adapted and configured to remove various materials e.g. muck, sludge, sediment, biomass, mud, and/or other non-desired materials, from the bottom surface of ponds, streams, lakes and/or other bodies of water.

Pump 12 includes a prime mover such an internal combustion engine or an electric motor, and a suction generating mechanism. The prime mover provides power to the suction generating mechanism which correspondingly creates suction power, whereby pump 12 provides the suction energy utilized by dredging system 10.

Preferably, pump 12 is adapted and configured to move a volume of at least about 36-thousand gallons of liquid per hour. Although the particular pump 12 is selected so as to provide suitable suction or vacuum and move a sufficient volume of liquid, be it more or less, based on the intended use environment of dredging system 10.

Gravity filter 14 functions to remove larger pieces of material from the stream of material being removed from the sediment bed of the body of water. The water-borne sediment stream enters filter 14 at the bottom of the filter canister, and effluent exits the filter at the top of the canister. The design is such that the heavier sediment particles/stones, rocks, fall out of the sediment stream and settle to the bottom of the canister. Although FIG. 1 illustrates a gravity filter, those skilled in the art are well aware of other suitable filtration mechanisms, such as, but not limited to, various other flow-through filters and/or others.

Pump 12 is connected to filter 14 by hose 20. Gravity filter 14 is connected to Y-connector 16 by hose 22. Y-connector 16 has one connector inlet member and two connector outlet members. In other words, Y-connector 16 splits the system suction power into two separate divergent paths, generally defined by and transmitted through the two connector outlet members and correspondingly through hoses 24A and 24B.

Hoses 24A, 24B extend between and connect ones of the two outlets of Y-connector 16 and respective ones of dredge head 18. In embodiments which utilize two dredge heads 18, such as that illustrated in FIG. 1, dredge system 10 enables two users to simultaneously work together, each using a separate dredge head 18, at locations proximate each other, whereby the divers can watch out for each other, and can both be gainfully employed in sediment removal.

Figure 2:
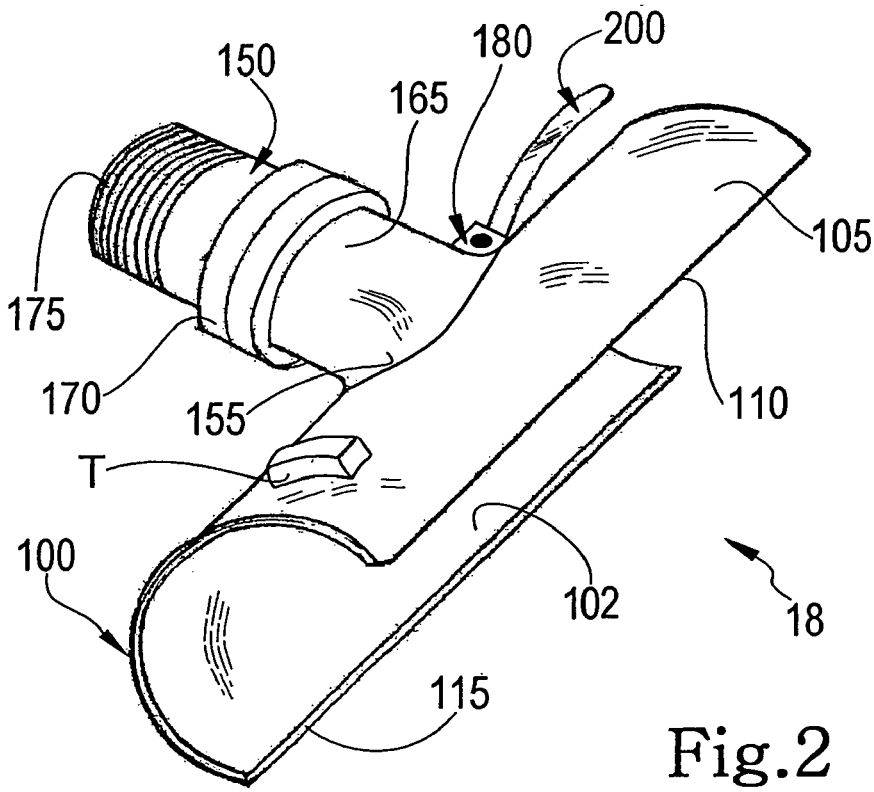
FIG. 2 shows an enlarged pictorial view of one of the two dredge heads of FIG. 1.

Referring now to FIG. 2, in general, suction heads, e.g. dredge heads 18 of the invention each includes blade 100, header tube 150, actuation mechanism 180, and actuatable arm 200. The entire assemblage of dredge head 18 is adapted and configured for relatively easy manipulation by a user, and to provide a means of attenuating the rate of entrance of non-desired debris into dredging system 10 through dredge head 18. Dredge head 18 further enables a user to, as desired, remove, clear, eliminate, and/or otherwise purge debris from the dredge head, generally without requiring the user to remove such debris with his or her hand.

Blade 100 is a plow or clip which generally defines the front portion of dredge head 18 which, as illustrated, has a length dimension which generally defines the overall width of dredge head 18, and is generally arcuate in profile. In other words, blade 100 defines a generally arcuate wall, first and second generally open end or side portions and a generally open front-most portion. The blade 100 is adapted and configured to contact and traverse surfaces such as bottom surfaces of bodies of water, and/or to contact, push, drag, cut through, agitate, and/or otherwise communicate or interface with substances and particles which are to be removed by dredging system 10.

Blade 100 includes inner and outer surfaces, namely, surfaces 102 and 105, respectfully. If the arcuate wall of blade 100 was arcingly projected to define a cylinder having generally the same radius as the radius of blade 100, inner surface 102 would generally define the inner circumferential surface of such cylinder and outer surface 105 would generally define the outer circumferential surface of such cylinder. Namely, inner surface 102 faces generally forward, away from the remainder of dredge head 18 whilst outer surface 105, at least a rearwardly facing portion thereof, faces generally rearward, toward the remainder of dredge head 18.

Figure 4:
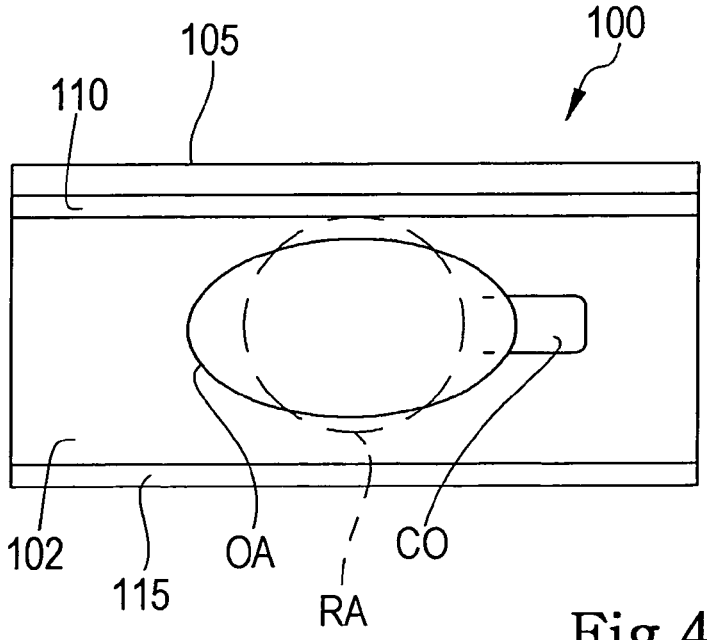
FIG. 4 shows a front elevation of first dredge head blade of the invention.

Referring now to FIG. 4, at least one opening or aperture extends generally medially through blade 100, e.g. though the entire thickness thereof. The particular shape e.g. outside perimeter shape is selected so as to provide an aperture of desired opening dimensions and overall configuration. Exemplary of such suitable shapes, dimensions, and configurations, are round and oval which correspond to round aperture "RA" and oval aperture "OA" which are illustrated in dashed and solid lines, respectively.

Channel opening "CO" also extends through the entire thickness of blade 100, proximate round aperture "RA" or oval aperture "OA." One end of channel opening "CO" opens and extends into the round or oval aperture "RA," "OA." In other words, the round or oval aperture "RA," "OA" and channel opening "CO," in combination, define an opening with at least first and second portions, one opening portion which generally defines an oval or circle and another portion which is generally elongate and extends from such oval or circular e.g. round opening.

Referring now to FIGS. 2, 3, 4, and 5, upper and lower leading edges 110 and 115, respectively, define the terminal edge surfaces at the forward-most portion of blade 100, whereby the wall which extends between upper leading edge 110 and lower leading edge 115 arcingly extends therebetween and generally defines a C-shaped profile when viewed from the side.

Figure 5:
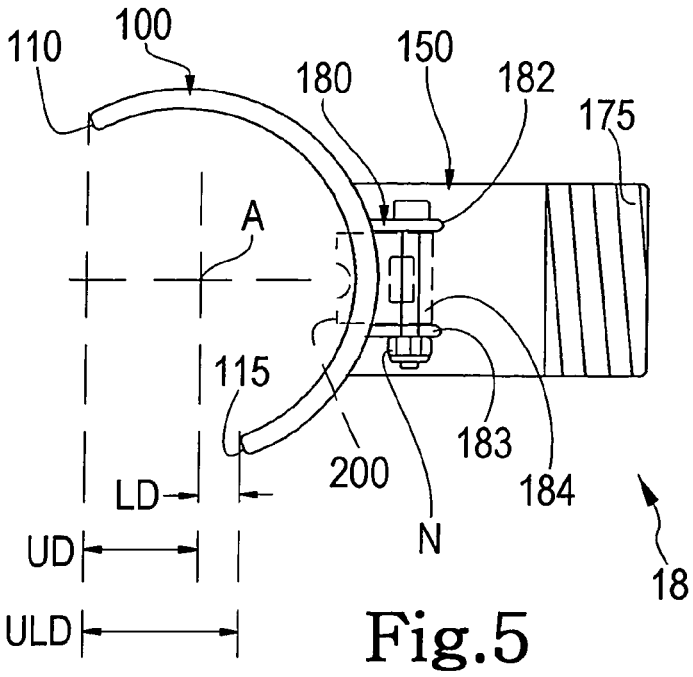
FIG. 5 shows a side elevation of the dredge head of FIG. 3 with the grate removed and the pivot pin and nut in place.

Referring now specifically to FIG. 5, when viewed in side elevation, from the left side of dredge head 18, the contour and profile of blade 100 defines a generally reverse-C profile configuration. Axis "A", viewed in end view in FIG. 5, extends axially through the cavity within blade 100, along the length thereof. In embodiments with a generally constant radius of blade 100, axis A is generally radially displaced the same distance from ones of any given points along the inner circumferential surface of blade 100 e.g. inner surface 102.

Upper edge 110 and lower edge 115 extend generally parallel to each other and are each displaced from an imaginary straight-line which extends through axis "A", generally perpendicular to header tube 150. Namely, upper edge 110 and lower edge 115 lie on generally different sides of such imaginary straight line, whereby the distance between such line and upper edge 110 defines a first, upper distance "UD" and the distance between such line and lower edge 115 defines a second, lower distance "LD."

The magnitude of upper distance "UD" is at least about twice the magnitude of the lower distance "LD". The overall distance between upper edge 110 and lower edge 115, as measured generally parallel to header tube 150, corresponds to the sum of the upper and lower distances "UD" and "LD" and generally defines the upper-lower distance "ULD."

Although blade 100 is illustrated as defining an arcuate wall with a generally uniform radius and generally straight lines leading edges, other suitable configurations are contemplated and well within the scope of the invention. Such other suitable configurations include, but are not limited to, blades which are generally angular in profile, blades which have generally non-planar appearances when viewed from above e.g. V-shaped as viewed from above, and/or others.

Upper edge 110 and lower edge 115 each has a length dimension which corresponds to the overall width dimension of blade 100. The magnitude of the length dimension of blade 100 is selected based at least in part on the particular intended use environment of dredge head 18, and/or based on other factors. Exemplary of suitably width dimensions of blade 100 include width dimensions having magnitudes of at least about 4 inches, at least about 4½ inches, at least about 5 inches, at least about 5½ inches, at least about 6 inches, at least about 6½ inches, at least about 7 inches, at least about 7½ inches, at least about 8 inches, and others.

The magnitude of the overall height dimension of blade 100, which corresponds to the distance between upper and lower edges 110, 115, includes any of a variety of suitable height dimensions, e.g. height dimensions having magnitudes of at least about 3 inches, at least about 3½ inches, at least about 4 inches, at least about 4½ inches, at least about 5 inches, at least about 5½ inches, at least about 6 inches, at least about 6½ inches, at least about 7 inches, and others.

The generally arcuate wall of blade 100 has a radius, or one or more radiused portions thereof, which provide blade 100 with a profile and thus scooping, pushing, plowing, digging, and/or other characteristics and functions which are suitable for the intended use environment. Namely, the generally arcuate wall of blade 100 defines a radius, or radiused portions thereof, of at least about 1½ inch, 2 inches, 2½ inches, 3 inches, and others.

Figure 3:
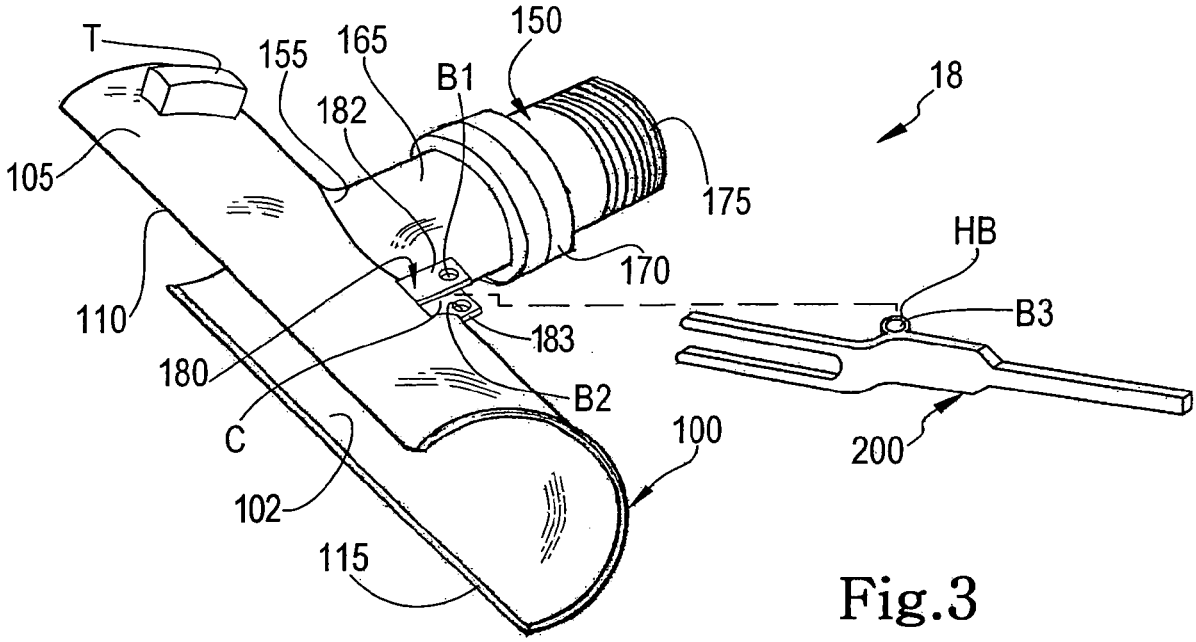
FIG. 3 shows an exploded, pictorial view of a second embodiment of dredge heads of the invention.

Referring now to FIGS. 2 and 3, thumb tab "T" is an elongate projection with a length, a width, and a thickness dimension, and further defines an upper and lower surface thereof. Thumb tab "T" is adapted and configured to support, interface with, and/or otherwise cooperate with, a thumb or finger of a user, as desired.

The lower surface of thumb tab "T" communicates with an upper portion of outer surface 105, whereby the remainder of thumb tab "T" extends upwardly therefrom. Accordingly, the thickness dimension of thumb tab "T" corresponds generally to the distance which thumb tab "T" extends from outer surface 105, e.g. the magnitude of the distance between outer surface 105 and the upper surface of thumb tab "T."

Thumb tab "T" is preferably positioned angularly and generally non-perpendicularly to e.g. upper and lower edges 110, 115, and angularly and generally non-parallel to e.g. header tube 150. Nevertheless, thumb tab "T" can be mounted anywhere upon dredge head 18, in any position and orientation, and have other characteristics and configurations which enable a user to grasp, hold, and/or otherwise manipulate dredge head 18 relatively more easily or comfortably as compared to dredge heads without such thumb tab "T." Optionally, dredge head 18 includes a plurality of thumb tabs "T," spaced from each other, which enable a user to grasp, hold, and/or otherwise manipulate dredge head 18 relatively more easily or comfortably as compared to dredge heads without ones of such thumb tabs "T."

Header tube 150 is an elongate, cylindrical member which extends generally perpendicularly from blade 100. In addition, an opening extends generally axially through header tube 150, whereby the header tube is a generally hollow member.

Header tube 150 generally defines various portions thereof, namely blade interface portion 155, front header portion 165, medial header portion 170, and rear header portion 175. The header tube 150 is adapted and configured to connect, and generally span between, blade 100 and various tubes, hoses, or other conduits, of dredge system 10, such as ones of hoses 24A, 24B.

Blade interface portion 155 defines a first end of header tube 150, proximate blade 100 and connected thereto. The particular shape and characteristics of the terminal end of blade interface portion 155 corresponds to e.g. contours, radii, outer circumferential surface characteristics of at least part of blade 100. In other words, the end of blade interface portion 155 is notched, machined, formed, cut, grinded, and/or otherwise adapted and configured to suitably interface with the respective portion of outer blade surface 105.

Figure 7:
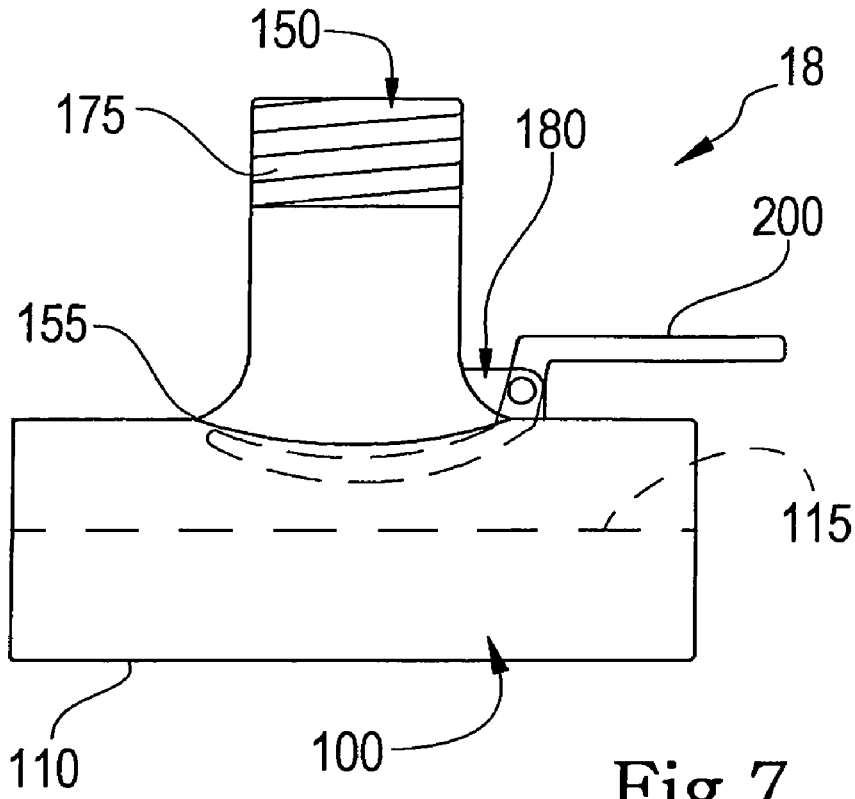
FIG. 7 shows a top view of a third embodiment of dredge heads of the invention.

As one example, referring to FIGS. 4 and 7, in embodiments which include oval blade apertures e.g. oval apertures "OA," blade interface portion 155 can include an oval crimp. Such oval crimp can be imparted to blade interface portion 155 by applying a vertically directed compressive force, sufficiently great in magnitude to squeeze the upper and lower surfaces of blade interface portion 155 relatively nearer each other, whereby the outer wall of blade interface portion 155 retains a generally oval shaped configuration.

In such embodiments, which have oval crimped blade interface portion ends, the lateral surfaces are flared laterally outwardly from the remainder of header tube 150. Accordingly, when viewed from above, each of the lateral sides of an oval crimped blade interface portion 155 appears to arcuately transition between blade 100 and the remainder of header tube 150, as illustrated in FIG. 7.

Figure 6:
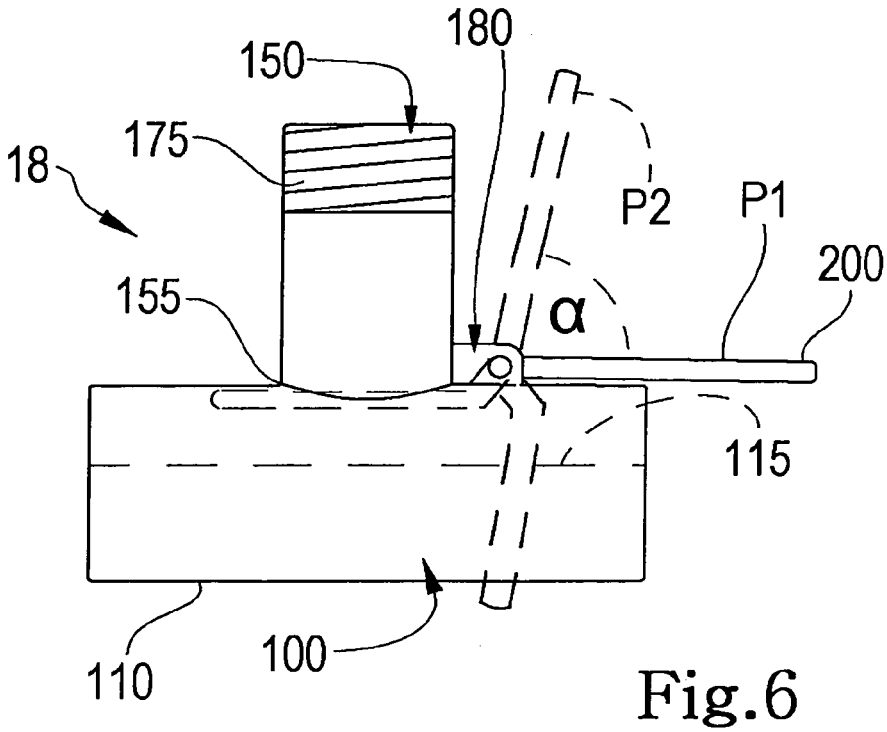
FIG. 6 shows a top view of the dredge head of FIG. 2, assembled.

As another example, referring to FIGS. 4 and 6, in embodiments which include round blade apertures e.g. round apertures "RA," blade interface portion 155, the end surfaces of the blade interface portion 155 defines a generally round shape, as viewed in an end view. In such embodiments, blade interface portion 155 extends generally perpendicularly from blade 100, as illustrated in FIG. 6. The end of blade interface portion 155 which is distal blade 100 is attached to front header portion 165.

Front header portion 165 is a generally cylindrical member which is adjacent and extends away from blade interface portion 155, namely away from blade 100. The opening, which extends axially through blade interface portion 155, opens and extends into an opening which extends axially through front header portion 165. In some embodiments, the end of front header portion 165 which is distal blade 100 is connected to medial header portion 170.

Medial header portion 170 is a generally cylindrical member, adjacent and extending away from, front header portion 165, namely away from blade 100. The opening which extends axially through blade interface portion 155 and front header portion 165 opens and extends into an opening which extends axially through medial portion 170.

As illustrated in FIGS. 2 and 3, as desired, medial header portion 170 can include one or more coupling mechanisms, which connect e.g. separable, distinct, portions of medial header portion 170. Such coupling mechanisms, illustrated as generally annular rings which concentrically surround parts of medial header portion 170, include, but are not limited to, threaded coupling mechanisms, snap-lock mechanisms, friction fit mechanisms, various adhesives and weldments, and/or other suitable coupling mechanisms.

In yet other embodiments, such as those illustrated in FIGS. 5, 6, and 7, the medial portion of header tube 150 is generally devoid of coupling mechanisms, whereby medial header portion 170 is generally not required in the assemblage of header tube 150. In such embodiments, front header portion 165 is connected generally -directly to rear header portion 175. By contrast, in embodiments which include medial header portion 170, front header portion 165 is connected generally indirectly to rear header portion 175, through the medial header portion 170.

Rear header portion 175 is a generally cylindrical member, adjacent and extending away from, medial header portion 170 and/or front header portion 165, namely away from blade 100. The opening which extends axially through blade interface portion 155, front header portion 165, optionally through medial portion 170, opens and extends into an opening which extends axially through rear header portion 175. In other words, a cavity extends through the aperture of blade 100 and axially through the entire length of header tube 150.

Accordingly, the opening which extends through blade interface portion 155 is generally coaxially aligned with the opening which extends through blade 100, be it round aperture "RA," oval aperture "OA," or others. Accordingly, as suction energy provided by pump 12 draws material e.g. muck, sediment, articles, materials, sludge, biomass, debris mud, and/or other substances, through the blade aperture "RA," "OA," such material is also drawn through the opening which extends through blade interface portion 155 and axially through the remainder of header tube 150.

Rear header portion 175 is adapted and configured to be removably attached to various tubes, hoses, or other conduits, of dredge system 10, such as ones of hoses 24A, 24B. Exemplary of such removable attachment structure and configuration are various threaded coupler devices, parts of which are illustrated in FIGS. 2, 3, 5, 6, and 7. In embodiments which include threaded coupler devices and/or configurations, rear header portion 175 includes a threaded outer circumferential surface.

The characteristics of the threaded outer circumferential surface, of rear header portion 175, corresponds to the characteristics of a threaded inner circumferential surface of a cooperating threaded coupling sleeve, attached to ones of the ends of e.g. hoses 24A, 24B. Namely, the cooperating threaded coupling sleeve and threaded outer circumferential surface of rear header portion 175 have threads with thread pitches and thread depths which correspond to each other, enabling a user to threadedly removably attach dredge head 18 to e.g. hoses 24A, 24B.

Nevertheless, rear header portion 175 can be otherwise adapted and configured to suitably, removably, attach dredge head 18 to hoses 24A, 24B. Such other suitable configurations include, but are not limited to, various snap-lock mechanisms, friction fit mechanisms, and/or others.

Referring now to FIGS. 2, 3, 5, 6, 7, 8, and 9, actuation mechanism 180 includes upper pivot plate 182, lower pivot plate 183, pivot pin 184, nut "N," and actuatable arm 200.

Upper pivot plate 182 is a generally planar member with an upper surface, a lower surface, forward and rearward facing edge surfaces, and first and second lateral surfaces. Upper pivot plate 182 spans generally between and is connected to ones of blade 100 and header tube 155. Namely, the first lateral edge surface of upper pivot plate 182 interfaces with and is attached to an outer side surface of blade interface portion 155, whereby the second lateral edge surface faces generally outwardly away from header tube 150.

The forward facing edge surface of upper pivot plate 182 interfaces with and is attached to a rearwardly facing portion of plow outer surface 105, above channel opening "CO." Bore "B1" extends through the entire thickness of upper pivot plate 182, illustrated in e.g. FIG. 3 as proximate the rearward facing edge surface and generally between the first and second lateral edge surfaces.

Lower pivot plate 183 is a generally planar member with an upper surface, a lower surface, forward and rearward facing edge surfaces, and first and second lateral surfaces. Lower pivot plate 183 spans generally between and is connected to ones of blade 100 and header tube 155. Namely, the first lateral edge surface of lower pivot plate 183 interfaces with and is attached to an outer side surface of blade interface portion 155, whereby the second lateral edge surface faces generally outwardly away from header tube 150.

The forward facing edge surface of lower pivot plate 183 interfaces with and is attached to a rearwardly facing portion of plow outer surface 105, below channel opening "CO." Bore "B2" extends through the entire thickness of lower pivot plate 183, illustrated in e.g. FIG. 3 as proximate the rearward facing edge surface and generally between the first and second lateral edge surfaces. Bore "B1" of upper pivot plate 182 and bore "B2" of lower pivot plate 183 are generally coaxially aligned with each other, enable e.g. pivot pin 184 to pass therethrough.

The lower surface of upper pivot plate 182 and the upper surface of lower pivot plate 183 generally define a void i.e. cavity "C" therebetween. The opening of cavity "C," which is proximate blade 100, is aligned with and opens and extends into cavity opening "CO" of blade 100. In other words, the void of cavity opening "CO" extends through blade 100, between upper and lower pivot plates 182, 183, and thus through cavity "C."

Pivot pin 184 is an elongate generally cylindrical structure adapted and configured to e.g. guide actuatable arm 200 in pivotal movement or travel. As illustrated in FIG. 5, pivot pin 184 is a bolt with a bolt heads a bolt shaft, and a threaded end. Nut "N" is sized, adapted, and configured to cooperatively interface with the threads of the pivot pin threaded end. Accordingly, pivot pin 184 extends axially through bores "B1" and "B2" and is generally retained therein by the bolt head of pivot pin 184 and nut "N."

Namely, the downwardly facing surface, e.g. the shoulder, of the bolt head of pivot pin 184 interfaces with the upper surface of upper pivot plate 182 and mechanically resists forces which tend to urge pivot pin 184 downwardly through bores "B1," "B2." And the upper surface of nut "N" interfaces with the lower surface of lower pivot plate 183 and mechanically resists forces which tend to urge pivot pin 184 upwardly through bores "B1," "B2." Pivot pin 184 includes other configurations which may or may not utilize a nut "N." Exemplary of such other suitable pivot pins include, but are not limited to, various other bolts, rolled pins, forged pins, cast pins, extruded pins, and/or other pins, various securing devices e.g. cotter pins, and keys, captured pins, clevis pins, split cotters, and/or others.

Accordingly, in the complete assemblage of dredge head 18, pivot pin 184 generally defines an axis of pivotation which is generally displaced from blade 100, about which actuatable arm 20 pivots.

Actuatable arm 200 is adapted and configured to attenuate the rate at which non-desired debris and/or other non-desired materials enter and pass through dredge head 18, optionally to generally prevent entrance of such non-desired materials into dredge head 18. Accordingly, actuatable arm 200 is adapted and configured to generally slow the rate, minimize the likelihood, or prevent passage, of such non-desired materials into dredge system 10.

Actuatable arm 200 further enables a user to, as desired, remove, clear, eliminate, and/or otherwise purge debris and/or other non-desired materials from the dredge head, generally without requiring the user to remove such debris with his or her hand. In other words, a user of dredge head 18 can remove, clear, eliminate, and/or otherwise purge debris and/or other non-desired materials from the dredge head while generally maintaining his or her hand(s), positionally, behind blade 100.

Actuatable arm 200 is movably actuatable, e.g. pivotably, slidably, and/or otherwise movably. Actuatable arm 200 includes handle end portion 205, handle medial portion 207, handle base portion 210, first arcuate transition portion 212, connecting portion 215, second arcuate transition portion 217, and grate 220.

Figure 9A:
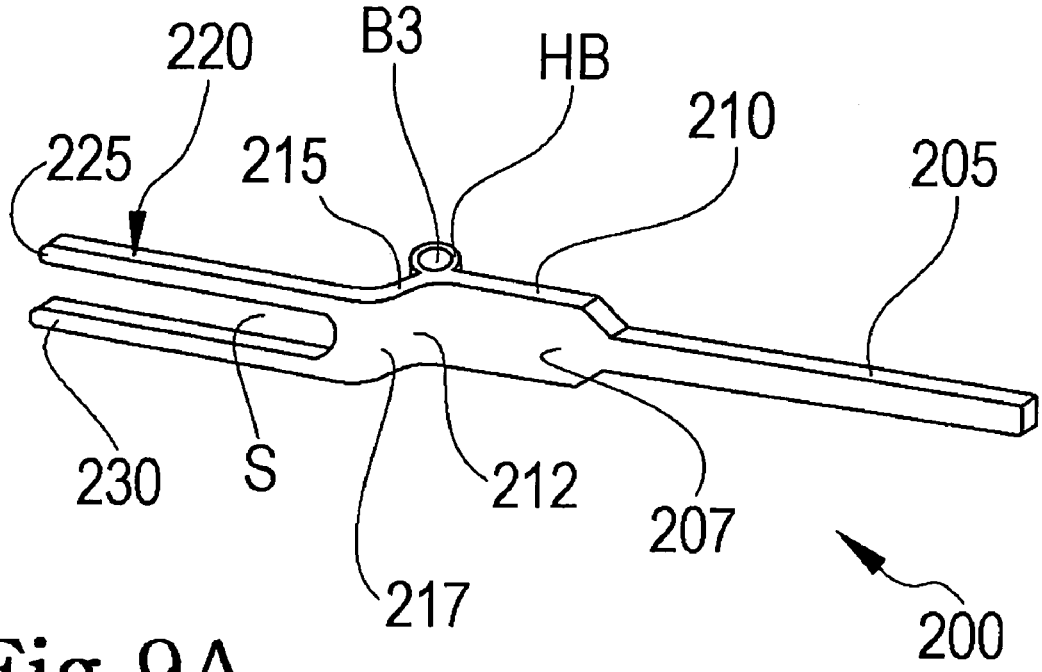
FIG. 9A shows an enlarged pictorial view of the grate of FIG. 2.
Figure 9B:
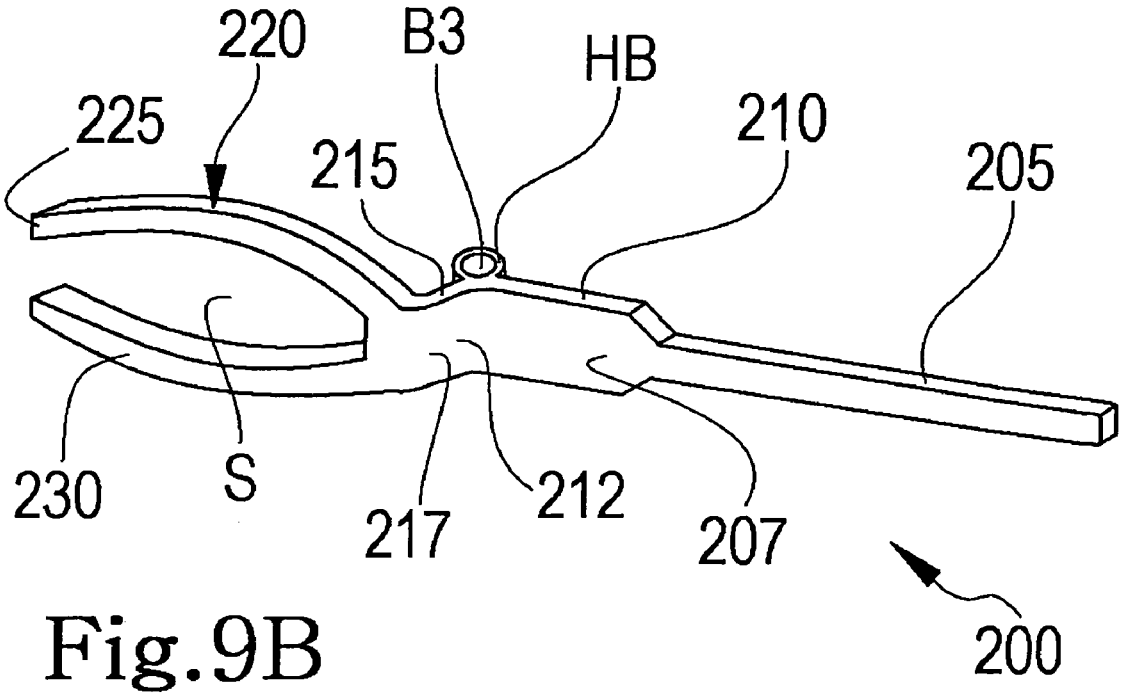
FIG. 9B shows an enlarged pictorial view of a second embodiment of grates used in dredge heads of the invention.

Referring now to FIGS. 9A, and 9B, handle end portion 205 is a generally elongate rigid member with first and second ends, forward and rearward facing surfaces, and upper and lower e.g. edge surfaces. The first end of handle end portion 205 faces generally away from the remainder of actuatable arm 200 and the second end of handle end portion 205 generally faces and is proximate the remainder of actuatable arm 200, and intersects handle medial portion 207.

Handle medial portion 207 includes first and second ends, a forward facing surface, a rearward facing surface, and upper and lower generally tapered surfaces. The forward and rearward facing surfaces of handle medial portion 207 are generally coplanar with respective ones of forward and rearward facing surfaces of handle end portion 205.

The first end of medial portion 207 connects to handle end portion 205 and defines a first width dimension. The second end of medial portion 207 connects to e.g. the remainder to actuatable arm 200 and defines a second width dimension. The magnitude of the second width dimension is greater than the magnitude of the first width dimension.

The upper tapered surface extends generally angularly upwardly between the uppermost point of intersection of handle end portion 205 and medial portion 207, and the uppermost point of intersection of medial portion 207 and handle base portion 210. The lower tapered surface extends generally angularly downwardly between the lowermost point of intersection of handle end portion 205 and medial portion 207, and the lowermost point of intersection of medial portion 207 and handle base portion 210. In other words, in some embodiments, handle end portion 205 is generally narrower than handle base portion 210 and medial portion 207 taperingly transitions between and connects handle end portion 205 and base portion 210.

Handle base portion 210 is a generally elongate rigid member with first and second ends, forward and rearward facing surfaces, and upper and lower e.g. edge surfaces. The first end of hand base portion 210 interfaces and is connected to handle medial portion 207 and the second end of hand base portion 210 interfaces and is connected to first arcuate transition portion 212.

Ones of the forward and rearward facing surfaces of handle base portion 210 are generally coplanar with respective ones of the forward and rearward facing surfaces of handle medial portion 207 and/or handle end portion 205. The upper and lower surfaces of handle base portion 210 extend generally parallel to each other, whereby handle base portion defines a generally constant width dimension along the length thereof.

First arcuate transition portion 212 includes forward and rearward facing surfaces, and upper and lower e.g. edge surfaces. First arcuate transition portion 212 is connected at a first end to handle base portion 210 and at a second end to connecting portion 215. Transition portion 212 extends generally arcuately, optionally straight-line angularly or otherwise, between such base portion 210 and connecting portion 215. Namely, first arcuate transition portion 212 extends generally arcuately away from the base portion 210, generally in the direction which the forward facing surface of base portion 210 faces.

Connecting portion 215 includes forward and rearward facing surfaces, and upper and lower e.g. edge surfaces. A first end of connecting portion 215 is connected to first arcuate transition portion 212 and a second end of connecting portion 215 is connected to second arcuate transition portion 217. Namely, connecting portion 215 generally defines an e.g. planar member which extends between and connects the first and second arcuate transition portions 212 and 217.

Second arcuate transition portion 217 includes forward and rearward facing surfaces, and upper and lower e.g. edge surfaces. Second arcuate transition portion 217 is connected at a first end to connecting portion 215 and at a second end to grate 220. Transition portion 217 extends generally arcuately, optionally straight-line angularly or otherwise, between such base connecting portion 215 and at a second end to grate 220. Namely, second arcuate transition portion 217 extends generally arcuately away from base connecting portion 215, whereby the end of second arcuate transition portion 217 which connects to grate 220 extends generally parallel to the direction in which handle base portion 210 extends.

In other words, first arcuate transition portion 212 and second arcuate transition portion 217 curvingly extend in generally opposite directions. Accordingly, in the entire assemblage of actuatable arm 200, first arcuate transition portion 212, connecting portion 215, and second arcuate transition portion 217, in combination, generally define a sigmoidal shape, outline, or perimeter, when viewed from above.

However, in some embodiments, actuatable arm 200 is generally devoid of first and second arcuate transition portions 212, 217, and base connecting portion 215, whereby the actuatable arm 200 is generally straight-line linear between e.g. ones of end portion 205, handle base portion 210, and grate 220.

Grate 220 includes at least one prong, preferably first and second prongs, namely upper prong 225 and lower prong 230, optionally other prongs e.g. in addition to upper and lower prongs 225, 230, such as three or more prongs, as desired. The assemblage of grate 200 generally defines a second end portion of actuatable arm 200, distal handle end portion 205. Grate 220 is movable and adapted and configured to selectively extend across at least part of the aperture which extends through blade 100.

Grate 220 is adapted and configured to prevent non-desired debris and materials, such as, but not limited to, rocks, sticks, other objects of certain minimum sizes, and/or others, from entering and traveling through dredge head 18 and thus into the remainder of dredging system 10. At the same time, grate 220 permits passage of certain materials which are desiredly removed from e.g. the water body bottom. Accordingly, grate 220 is adapted and configured to balance the amount of obstruction which is employed to beneficially protect the system equipment, while still enabling passage of the desired sediments.

Upper prong 225 is an elongate generally rigid member with first and second ends, upper and lower surfaces, forward facing and rearward facing surfaces, and an end surface. The first end of upper prong 225 communicates with and is attached to second arcuate transition portion 217

The forward facing surface of upper prong 225 generally faces the same direction as the forward facing surfaces of e.g. handle end portion 205, handle medial portion 207, and handle end portion 210. Correspondingly, the rearward facing surface of upper prong 225 generally faces the same direction as the rearward facing surfaces of e.g. handle end portion 205, handle medial portion 207, and handle end portion 210.

The upper surface of upper prong 225 generally faces the same direction as the upper surfaces of e.g. handle end portion 205 and handle end portion 210. The lower facing surface of upper prong 225 generally faces the same direction as the lower surfaces of e.g. handle end portion 205, handle medial portion 207, and handle end portion 210. And the end surface of upper prong 225 faces a generally opposite direction than the direction that the end surface of handle end portion 205 faces.

Figure 8:
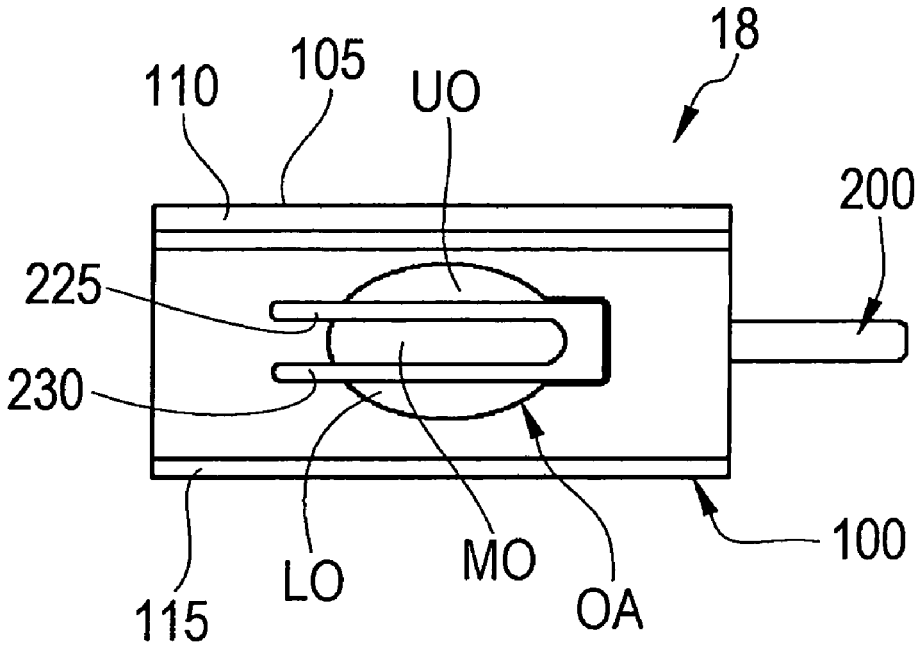
FIG. 8 shows a front elevation of the dredge head of FIG. 6.

Referring now to FIGS. 6 and 8, when actuatable arm 200 is in a first position, designated as position "P1" in FIG. 6, upper prong 225 extends beyond the outer lateral perimeter of the blade aperture, and beyond e.g. the header tube/blade interface 155. Namely, upper prong 225 extends beyond the header tube/blade interface 155 by at least about 1/64 inch, at least about 1/32 inch, at least about 1/16 inch, at least about 1/8 inch, at least about 1/4 inch, at least about 1/2 inch, at least about 5/8 inch, at least about 7/8 inch, optionally at least about 1 inch, optionally others.

Accordingly, in first position "P1," the rearward facing surface of upper prong 225, at or adjacent the end of upper prong 225, interfaces with the inner e.g. forward facing surface 102 of blade 100. However, in other embodiments, upper prong 225 extends less than the entire distance across the blade aperture, whereby when actuatable arm 200 is in first position "P1," generally no part of the rearward facing surface upper prong 225 interfaces with the inner e.g. forward facing surface 102 of blade 100.

In some embodiments, such as that illustrated in FIG. 9B, upper prong 225 is generally arcuate, when viewed in a front elevation. In such embodiments, upper prong 225 extends arcuately, optionally straight-line linearly, upwardly from the point of intersection between upper prong 225 and second arcuate transition portion 217 to a maximum height or uppermost portion. From the maximum height or uppermost portion, upper prong 225 extends arcuately, optionally straight-line linearly, downwardly toward the terminal end thereof.

In some embodiments, such as that illustrated in FIG. 7, upper prong 225 is generally arcuate, when viewed from above. In such embodiments, upper prong 225 extends arcuately, optionally straight-line linearly, outwardly from the point of intersection between upper prong 225 and second arcuate transition portion 217, e.g. outwardly away from blade 100, to a point of maximum extension or outermost portion. From the maximum extension or outermost portion, upper prong 225 extends arcuately, optionally straight-line linearly, inwardly toward blade 100 and toward the terminal end of the upper prong 225.

Referring now to FIGS. 9A and 9B, lower prong 230 is an elongate generally rigid member with first and second ends, upper and lower surfaces, forward facing and rearward facing surfaces, and an end surface. The first end of lower prong 230 communicates with and is attached to second arcuate transition portion 217

The forward facing surface lower prong 230 generally faces the same direction as the forward facing surfaces of e.g. handle end portion 205, handle medial portion 207, handle end portion 210, and upper prong 225. Correspondingly, the rearward facing surface of lower prong 230 generally faces the same direction as the rearward facing surfaces of e.g. handle end portion 205, handle medial portion 207, handle end portion 210, and upper prong 225.

The upper surface of lower prong 230 generally faces the same direction as the upper surfaces of e.g. handle end portion 205 and handle end portion 210, and faces the lower surface of upper prong 225. The lower facing surface of lower prong 230 generally faces the same direction as the lower surfaces of e.g. handle end portion 205, handle medial portion 207, handle end portion 210, and upper prong 225. The end surface of lower prong 230 faces a generally opposite direction than the direction that the end surface of handle end portion 205 faces.

The magnitude of the length dimension of ones of upper prong 225, lower prong 230, or other prong(s) is optionally less than about 3 inches but preferably at least about 3 inches, at least about 3.5 inches, at least about 4 inches, at least about 4.5 inches, and others.

The magnitude of the width dimension of ones of upper prong 225, lower prong 230, or other prong(s) is optionally less than about 1/8 inch but preferably at least about 1/8 inch, at least about 1/4 inch, at least about 3/8 inch, and others.

The distance between e.g. upper prong 225 and lower prong 230 has a magnitude of, for example, at least about 1/8 inch, at least about 1/4 inch, at least about 3/8 inch, at least about 1/2 inch, at least about 5/8 inch, at least about 3/4 inch, at least about 7/8 inch, at least about 1 inch, and others.

The distance between the upper surface of upper prong 225 and the lower surface of lower prong 230, e.g. the overall width dimension of grate 220, has a magnitude of, for example, at least about 1/2 inch, at least about 5/8 inch, at least about 3/4 inch, at least about 7/8 inch, at least about 1 inch, at least about 1 1/8 inch, at least about 1 1/4 inch, at least about 1 3/8 inch, at least about 1 1/2 inch, at least about 1 5/8 inch, at least about 1 3/4 inch, at least about 1 7/8 inch, at least about 2 inches, and others.

Referring now to FIGS. 6 and 9A, a first angle e.g. the angle defined between handle ones of handle end portion 205, handle medial portion 207, handle base portion 210 and connecting portion 215, and a second angle e.g. the angle defined between connecting portion 215 and grate 220, generally correspond to each other. Namely, such first and second angles correspond in magnitude to each other, whereby ones of handle end portion 205, handle medial portion 207, handle base portion 210 and the grate 220 are parallel to each other, yet offset or stepped from each other e.g. are not coplanar with each other.

The distance measured perpendicularly between a straight-line projected from the rearward facing surface of grate 220 and the forward facing surfaces of ones of handle end portion 205, handle medial portion 207, and handle base portion 210 corresponds in magnitude to the magnitude of the thickness dimension of blade 100. Accordingly, when actuatable arm 200 is in the first position "P1," the rearward facing surface of grate 220 closely communicates with and faces the inner e.g. forward facing surface 102 of blade 100. Also, the forward facing surfaces of ones of handle end portion 205, handle medial portion 207, and handle base portion 210 closely communicate with and face the outer e.g. rearward facing surface 105 of blade 100.

Referring now to FIGS. 6 and 8, when actuatable arm 200 is in first position "P1" (FIG. 6), lower prong 230 extends beyond the outer lateral perimeter of the blade aperture, and beyond e.g. the header tube/blade interface 155. Namely, lower prong 230 extends beyond the header tube/blade interface 155 by at least about 1/64 inch, at least about 1/32 inch, at least about 1/16 inch, at least about 1/8 inch, at least about 1/4 inch, at least about 1/2 inch, at least about 5/8 inch, at least about 7/8 inch, optionally at least about 1 inch, optionally others.

Accordingly, in first position "P1," the rearward facing surface of lower prong 230, at or adjacent the end of lower prong 230, interfaces with the inner e.g. forward facing surface 102 of blade 100. However, in other embodiments, lower prong 230 extends less than the entire distance across the blade aperture, whereby when actuatable arm 200 is in first position "P1," generally no part of the rearward facing surface lower prong 230 interfaces with the inner e.g. forward facing surface 102 of blade 100.

In some embodiments, such as that illustrated in FIG. 9B, lower prong 230 is generally arcuate, when viewed in a front elevation. In such embodiments, lower prong 230 extends arcuately, optionally straight-line linearly, downwardly from the point of intersection between lower prong 230 and second arcuate transition portion 217 to a minimum height or lowermost portion thereof. From the minimum height or lowermost portion, lower prong 230 extends arcuately, optionally straight-line linearly, upwardly toward the terminal end thereof.

In some embodiments, such as that illustrated in FIG. 7, lower prong 230 is generally arcuate, when viewed from above. In such embodiments, lower prong 230 extends arcuately, optionally straight-line linearly, outwardly from the point of intersection between lower prong 230 and second arcuate transition portion 217, e.g. outwardly away from blade 100, to a point of maximum extension or outermost portion. From the maximum extension or outermost portion, lower prong 230 extends arcuately, optionally straight-line linearly, inwardly toward blade 100 and toward the terminal end of the lower prong 230.

Referring now to FIGS. 3, 9A, and 9B, actuatable arm 200 includes a connecting mechanism e.g. hinge barrel "HB," which is adapted and configured to, alone or in combination with other components, connect arm 200 to the remainder of dredge head 18. Hinge barrel "HB" is an elongate, cylindrical member with an upper end, a lower end, and an outer circumferential surface. A through bore, namely bore "B3," extends axially through hinge barrel "HB."

Hinge barrel "HB" extends generally upright and vertically and is fixedly attached the remainder of actuatable arm 200. In other words, a portion of the outer circumferential surface of hinge barrel "HB" is attached to the rearward facing surface, optionally the forward facing surface, of handle base portion 210, adjacent the intersection of base portion 210 and first arcuate transition portion 212, optionally elsewhere along the length of actuatable arm 200.

In the entire assemblage of dredge head 18, hinge barrel "HB" is generally housed within the actuation mechanism 180, e.g. between upper pivot plate 182 and lower pivot plate 183, whereby actuatable arm 200 is pivotably connected to the remainder of dredge head 18. In other words, hinge barrel "HB" occupies part of the void within channel "C."

The magnitude of the length dimension of hinge barrel "HB" corresponds to the distance between the lower surface of upper pivot plate 182 and the upper surface of pivot plate 183. Namely, hinge barrel "HB" fits snugly between the upper and lower pivot plates 182, 183, yet freely enough to sufficiently enable a user to, using one hand, pivotably actuate actuatable arm 200 as desired.

Referring now to FIG. 3, when actuatable arm 200 is pivotably connected to the remainder of dredge head 18, bore "B1" of upper pivot plate 182, bore "B3" of actuatable arm 200, and bore "B2" of lower pivot plate 183, are generally coaxially aligned with each other. Pivot pin 184 extends axially through bores "B1," "B2," and "B3" thereby pivotably attaching actuatable arm 200 to e.g. upper and lower pivot plates 182, 183. The particular spatial, dimensional, frictional, and/or other characteristics and relationships realized and/or defined between respective ones of upper and lower pivot plates 182, 183, pivot pin 184, hinge barrel "HB," and others, are selected to suitably provide the desired use characteristics of dredge head 18 e.g. desired amount of free-play between actuatable arm 200 and the remainder of dredge head 18, and/or others.

In the complete assemblage of dredge head 18, the actuatable arm 200 is generally free of freely or loosely wobbling characteristics or otherwise generally free from movement in non-desired manners, with respect to the other components of dredge head 18. In other words, when a user applies a force, upwardly or downwardly upon handle end portion 205, actuatable arm 200 generally does not wobble upon pivot pin 184, whereby the shape, dimensions, and overall perimeter characteristics of the blade apertures remain generally or substantially the same as the shape, dimensions, and overall perimeter characteristics of the blade apertures when handle end portion 205 is generally not under such user applied force.

The clearance between e.g. (i) the upper surface of hinge barrel "HB" and/or other upper surfaces of actuatable arm 200 and the lower surface of upper pivot plate 182, and/or (ii) the lower surface of hinge barrel "HB" and/or other lower surfaces of actuatable arm 200 and the upper surface of lower pivot plate 183, and/or (iii) other portions of actuatable arm 200 which interface or communicate with respective portions of actuation mechanism 180, is less than about 1/4 inch, less than about 3/16 inch, less than about 1/8 inch, less than about 1/16 inch, less than about 1/32 inch, and others, as desired.

Accordingly, in the complete assemblage of dredge head 18, hinge barrel "HB" and/or other portions of actuatable arm 200 which interface or communicate with respective portions of actuation mechanism 180, extend along and e.g. cover more than about 1/2 of the length of pivot pin 184, at least about 2/3 of the length of pivot pin 184, at least about 3/4 of the length of pivot pin 184, at least about ⅞ of the length of pivot pin 184, and others, as desired.

In some embodiments of the complete assemblage of dredge head 18, hinge barrel "HB" and/or other portions of actuatable arm 200 which interface or communicate with respective portions of actuation mechanism 180, extend along and e.g. cover more than about ½ of the portion of the length of pivot pin 184 which extends between upper and lower pivot plates 182, 183, at least about ⅔ of the portion of the length of pivot pin 184 which extends between upper and lower pivot plates 182, 183, at least about ¾ the portion of the length of pivot pin 184 which extends between upper and lower pivot plates 182, 183, at least about ⅞ of the portion of the length of pivot pin 184 which extends between upper and lower pivot plates 182, 183, and others, as desired.

Referring now to FIGS. 6 and 8, when actuatable arm 200 is in first position "P1," grate 220 and/or the prong(s) which at least partially define grate 220, extend across the blade aperture and thereby define separate, distinct portions of the blade aperture. The number, shapes, profiles, and other configurations of the distinct aperture portions are based, at least in part, on e.g. the number, shapes, and configurations, of the prongs of actuatable arm 200.

As one example, in embodiments of dredge head 18 which include a single prong, when actuatable arm 200 is in first position "P1," the single prong generally separates the opening of the blade aperture into first and second portions, the first opening above the single prong and the second opening below the single prong.

As another example, in embodiments of dredge head 18 which include upper and lower prongs 225 and 230, such as the embodiment illustrated in FIG. 8, the actuatable arm 200, in the first position "P1," generally defines first second and third opening which extend into the blade aperture.

Namely, the portion of oval aperture "OA" which is generally between the upper surface of upper prong 225 and the upper portion of the perimeter of oval aperture "OA" generally defines upper opening "UO." The portion of oval aperture "OA" which is generally between the lower surface of upper prong 225 and the upper surface of lower prong 230 generally defines medial opening "MO." And the portion of oval aperture "OA which is generally between the lower surface of lower prong 230 and the lower portion of the perimeter of oval aperture "OA" generally defines lower opening "LO."

Accordingly, upper opening "UO" has a generally planar lower perimeter edge and a generally arcuate upper perimeter edge. Medial opening "MO" has generally planar upper and lower perimeter edges, generally parallel to each other, and generally arcuate side perimeter edges. Lower opening "LO" has a generally planar upper perimeter edge and a generally arcuate lower perimeter edge.

In embodiments of dredge head 18 which include arcuate upper and lower prongs 225, 230, such as that illustrated in FIG. 9B, upper and lower openings "UO" and "LO" have generally crescent shaped perimeter edges. Also in such embodiments, medial opening "MO" defines a generally elliptical perimeter.

In embodiments in which actuatable arm 200 includes three or more prongs, the actuatable arm 200 generally defines four or more openings which extend into the blade aperture. The particular shape, profile, and/or other configuration of ones of the openings correspond to the particular shape, profile, and/or other configuration, of ones of the prongs of actuatable arm 200.

Referring now to FIGS. 2, 3, 5, 6, and 7, and more particularly to e.g. actuatable interactions between various components of dredge head 18, in the complete assemblage of dredge head 18, actuatable arm 200 is pivotably attached to the remainder of the dredge head. In other words, actuatable arm 200 is adapted and configured to pivotably move between first position "P1" and a second position "P2" (FIG. 6).

Regarding the complete assemblage of dredge head 18, a first portion of actuatable arm 200 lies generally movably in front of the inner e.g. forward facing surface 102 of blade 100 whilst a second portion of actuatable arm 200 lies generally movably rearward of the outer e.g. rearward facing surface 105 of blade 100. Namely, grate 220 and/or other parts of actuatable arm 200 are pivotably and/or otherwise movably positioned in front of or forward of blade inner surface 102, generally within the cavity or void defined within inner surface 102 of the arcuate wall of blade 100. Handle end portion 205 and/or other parts of actuatable arm 200 are pivotably and/or otherwise movably positioned behind the rearward facing outer surface 105 of blade 100.

When actuatable arm 200 is in position "P1" (FIG. 6), as discussed in greater detail elsewhere herein, portions of the actuatable arm 200, such as grate 220, movably and selectably extend across portions of the aperture of blade 100, e.g. oval or round aperture "OA," "RA." And when actuatable arm 200 is in position "P2," portions of the arm 200 such as grate 220 generally do not extend across, cover, or communicate with, the blade aperture. The user pivots actuatable arm 200 to infinitely vary the position of the arm 200, in real-time, between first position "P1" and second position "P2" as desired.

Referring now to FIG. 6, the pivotable travel of actuatable arm 200 can be generally defined with respect to the arcuate or pivotable travel of handle end portion 205. Namely, angle $\alpha$ generally defines the pivotably distance traveled as actuatable arm 200 pivots from first position "P1" to second position "P2," about an axis of pivotation generally defined by pivot pin 184.

Since grate 220 is fixedly attached to handle end portion 205, directly or by way of various intermediary structures such as, but not limited to, various ones of handle medial portion 207, handle base portion 210, first arcuate transition portion 212, connecting portion 215, and second arcuate transition portion 217, as handle end portion 205 pivotably travels in a first direction, grate 220 correspondingly pivotably travels in a second, generally opposite, direction. Accordingly, the angular distance traveled by handle end portion 205 and grate 220 correspond to each other.

The magnitude of angle $\alpha$ is selected to provide suitable use characteristics of dredge head 18. In other words, the magnitude of angle $\alpha$ is sufficiently great so that as handle end portion 205 is pivoted toward position "P2," the non-desired debris and/or other non-desired materials which accumulate at, on, and/or otherwise adjacent, grate 220, slides from, falls from, or is e.g. otherwise, eliminated, ridded, and/or otherwise removed from grate 220, without decreasing the suction power provided by pump 12.

The magnitude of angle $\alpha$ can be any of a variety of suitable magnitudes of angles, which include, but are not limited to, e.g. at least about 45 degrees, at least about 50 degrees, at least about 55 degrees, at least about 60 degrees, at least about 65 degrees, at least about 70 degrees, at least about 75 degrees, at least about 80 degrees, at least about 85 degrees, and others.

When actuatable arm 200 is in first position "P1," the end of the grate 220 is positioned laterally beyond a straight-line projected from the second header tube lateral surface which is most proximate the end of grate 220 (FIG. 6). And when the actuatable arm 200 is in the second position "P2," the end of grate 220 is positioned generally between a straight-line projected from a first header tube lateral surface and a straight-line projected from a second header tube lateral surface, optionally laterally outwardly beyond such straight-line projected from the second header tube lateral surface.

To use dredge head 18, the user connects, e.g. threadedly or otherwise couples, rear header portion 175 to a suitable hose such as ones of hoses 24A, 24B. The user then energizes pump 12 and thereby activates the dredging system 10, and dives or submerges to the bottom of the body of water to be cleaned.

The user grippingly holds dredge head 18 by way of grasping various portions thereof and preferably by also clutching thumb tab "T" with his or her thumb. Once the user secures dredge head 18 in his or her hand, the user manipulates dredge head 18 so that blade 100 interfaces the bottom surface of the body of water and thus interfaces the various materials to be removed e.g. muck, sludge, sediment, biomass, mud, and/or other non-desired materials.

The non-desired materials are then suctioningly forced upwardly through dredge head 18, the hose or series of hoses, into and/or through gravity filter 14, whereby the materials which pass through gravity filter 14 ultimately pass through and are discharged from pump 12, hence removed from the bottom surface of the body of water.

As certain materials and/or objects accumulate at grate 220, the user clears such debris e.g. material accumulation and/or material obstruction of dredge head 18 by pivoting actuatable arm 200. Namely, as the user desires to clear the debris from dredge head 18, the user applies a force to handle end portion 205 which urges handle end portion 205 arcuately back, generally toward e.g. rear header portion 175 and the hose connected to the dredge head 18, whereby actuatable arm pivots from first position "P1" toward second position "P2."

As handle end portion 205 pivots arcuately backwardly, grate 220 pivots generally arcuately forward and laterally, about a common axis of pivotation defined by pivot pin 184. When grate 220 is pivoted sufficiently far, in other words when actuatable arm is pivoted sufficiently close to second position "P2," the materials and/or objects which are accumulated upon grate 220 are generally out of the suction line or suction column which extends outwardly from the blade apertures, e.g. round or oval aperture "RA," "OA," so that the materials and/or objects which are accumulated upon grate 220 are under relatively less influence of the suction force of dredge head 18. Accordingly, when the suction force applied to such materials and/or objects which are accumulated upon grate 220 is sufficiently low, the materials and/or objects which are accumulated upon grate 220, slide from, fall from, or are e.g. otherwise, eliminated, ridded, and/or otherwise removed, gravitationally or otherwise, from grate 220.

Then, once dredge head 18 is sufficiently cleared, the user pivots actuatable arm 200 back toward first position "P1," whereby grate 220 extends generally across the blade aperture, thereby providing a mechanical interface which protects dredge system 10 from having at least some non-desired objects/materials entering thereinto.

In some embodiments, the surface area defined by the rearwardly facing surfaces of prongs 225, 230 is sufficiently great so that the suction force of dredge head 18 suctioningly urges grate 220 against blade 100. In other words, in some embodiments, the suction generated by pump 12 pulls and holds the grate 220 back against blade 100, whereby the resting condition of actuatable arm 200, when pump 12 is energized, is the first position "P1." Nevertheless, in such embodiments, grate 220 is adapted and configured, e.g. the surface area of grate 220 is sufficiently small, so that the user can overcome such suctioningly biasing force, which enables a user to pivotably move actuatable arm 200 between the first and second positions "P1," "P2," as desired.

Although dredge head 18 has been described with respect to embodiments having actuation mechanism 180 and thus pivot pin 184 located on a first side of the dredge head device, and accordingly having actuatable arm 200 extending generally in a first direction, it is fully appreciated and well within the scope of the invention that dredge head 18 can include e.g. actuation mechanism 180 and thus pivot pin 184 located on a second, opposite side of the dredge head device, and accordingly have actuatable arm 200 extending in a generally second, opposite direction. In such embodiments, the dredge head 18 is generally a mirror image of the illustrated embodiments, as reflected about a line which extends medially through the dredge head 18.

In some embodiments, dredge head 18 includes first and second actuatable arms 200. The actuatable arms 200 can be located on and/or pivot from generally the same side of the dredge head whereby, for example, the arms 200 are vertically or otherwise stacked with respect to each other. Optionally, ones of the plurality of actuatable arms 200 are located on and/or pivot from different sides of the dredge head 18, whereby, for example, the arms 200 are stacked with respect to each other or have e.g. intertwining or otherwise interfacing components such as various cooperating prongs.

In yet other embodiments, actuatable arm(s) 200 can pivot generally upwardly, downwardly, or otherwise, besides laterally as illustrated. For example, in embodiments in which an actuatable arm pivots generally upwardly or downwardly, various components of dredge head 18 are located at e.g. upper or lower portions thereof. In other words, in embodiments in which an actuatable arm 200 is pivotably movable generally arcuately upwardly or downwardly, actuation mechanism 180, pivot pin 184, cavity "C," cavity opening "CO," and/or other components, are e.g. rotated about 90 degrees and adapted and configured to the dredge head 18, whereby gate 220 is adapted and configured to pivot generally or generally downwardly, as desired.

Preferably, dredge head 18 is made of materials which resist corrosion, and are suitably strong and durable for normal extended use. Those skilled in the art are well aware of certain metallic and non-metallic materials which possess such desirable qualities, and appropriate methods of forming such materials.

Appropriate metallic materials for components of movable outdoor dredge head 18, such as but not limited to blade 100, header tube 150, actuation mechanism 180, pivot pin 184, actuatable grate 200, and/or others, include, but are not limited to, anodized aluminum, aluminum, steel, stainless steel, titanium, magnesium, brass, and their respective alloys. Common industry methods of forming such metallic materials include: casting, forging, shearing, bending, machining, riveting, welding, powdered metal processing, extruding, molding, and others.

Non-metallic materials suitable for components of dredge head 18 are various polymeric compounds, such as for example and without limitation, various of the polyolefins, such as a variety of the polyethylenes, e.g. high density polyethylene, or polypropylenes. There can also be mentioned as examples such polymers as polyvinyl chloride and chlorinated polyvinyl chloride copolymers, various of the polyamides, polycarbonates, and others.

For any polymeric material employed in structures of the invention, any conventional additive package can be included such as, for example and without limitation, slip agents, anti-block agents, release agents, anti-oxidants, fillers, and plasticizers, to control e.g. processing of the polymeric material as well as to stabilize and/or otherwise control the properties of the finished processed product, also to control hardness, bending resistance, and the like.

Common industry methods of forming such polymeric compounds will suffice to form non-metallic components of dredge head 18. Exemplary, but not limiting, of such processes are the various commonly-known plastics converting processes.

Dredge head 18 is preferably manufactured as individual components, and the individual components assembled as sub-assemblies, including but not limited to, blade 100, header tube 150, actuation mechanism 180, pivot pin 184, nut "N," actuatable grate 200, and/or others. Each of the aforementioned sub-assemblies is then assembled to respective other ones of the sub-assemblies to develop dredge head 18.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

The invention claimed is:

1. A dredge head comprising:

a) a blade having an arcuate cross-sectional profile with a forward facing surface, a rearward facing surface, and a thickness therebetween, said blade having a blade opening and a channel opening both of which extend through said thickness, and said channel opening being positioned adjacent to said blade opening;

b) a header tube having a forward facing end, a rearward facing end, and an aperture which extends axially therethrough said forward facing end interfacing with said rearward facing surface of said blade, and said aperture being coaxially aligned with said blade opening and being positioned adjacent to said channel opening;

c) a grate extending completely across and beyond said blade opening, said grate having an upper grate prong spaced apart from a lower grate prong and defining an elongate slot therebetween, said grate being movable between a first position and a second position, and when said grate is in said first position, said upper grate prong, said lower grate prong and said elongated slot extends across and beyond said blade opening and said upper and lower grate prongs contact said forward facing surface and partially limits flow through said blade opening, and when said grate is in said second position, said upper grate prong, said lower grate prong and said elongated slot are aligned at an angle to said blade opening and said upper and lower grate prongs are less restrictive in limiting flow through said blade opening; and d) an articulatable member pivotably secured to said header tube and being operably connected to said grate, said articulatable member being movable between a first position which corresponds to said first position of said grate and a second position which corresponds to said second position of said grate, and said articulatable member having a handle integrally formed with said grate and being offset at an angle therefrom by a first arcuate transition portion.

2. The dredge head of claim 1 wherein said upper and lower grate prongs are joined together at said first arcuate transition portion, said first arcuate transition portion being located at one end of said elongated slot, and said elongated slot having a width dimension that corresponds to the distance between said upper and lower grate prongs and a length dimension that corresponds to the length dimension of each of said upper and lower grate prongs, and said length dimension being greater than said width dimension.

3. The dredge head of claim 2 wherein said articulatable member is pivotably secured to both said header tube and to said rear facing surface of said blade by a single pivot pin.

4. The dredge head of claim 3 wherein said blade opening and said channel opening are aligned parallel to one another and said articulatable member passes through said channel opening.

5. The dredge head of claim 2 wherein said first arcuate transition portion is positioned in said channel opening and a hinge barrel is secured to said first arcuate transition portion.

6. The dredge head of claim 2 wherein when said grate is in said first position, said upper and lower prongs create only three openings which extend into said blade opening.

7. The dredge head of claim 3 wherein said blade has a reverse C-shaped profile with a longitudinal central axis which extends lengthwise through said profile, and said pivot pin is aligned tangential to said rear facing surface of said blade and perpendicular to said longitudinal central axis.

8. The dredge head of claim 2 wherein each of said upper and lower prongs has a forward facing surface, a portion of which contacts said forward facing surface of said blade, and said handle has a rearward facing surface, a portion of which contacts said rearward facing surface of said blade.

9. A dredging system comprising said dredge head of claim 7.

10. A dredge head comprising:

a) a blade having a reverse C-shaped, arcuate cross-sectional profile with a longitudinal central axis which extends lengthwise through said profile, said blade having a forward facing surface, a rearward facing surface, and a thickness therebetween, said blade having a blade opening and a channel opening both of which extend through said thickness, and said channel opening being positioned adjacent to said blade opening;

b) a header tube having a forward facing end, a rearward facing end, and an aperture which extends axially therethrough said forward facing end interfacing with said rearward facing surface of said blade, and said aperture being coaxially aligned with said blade opening and being positioned adjacent to said channel opening;

c) a grate extending completely across and beyond said blade opening, said grate having an upper grate prong spaced apart from a lower grate prong and defining an elongate slot therebetween, said grate being pivotably movable between a first position and a second position, and when said grate is in said first position, said upper grate prong, said lower grate prong and said elongated slot extends across and beyond said blade opening and said upper and lower grate prongs contact said forward facing surface of said blade and partially limits flow through said blade opening, and when said grate is in said second position, said upper grate prong, said lower grate prong and said elongated slot are aligned at an angle to said blade opening and said upper and lower grate prongs are less restrictive in limiting flow through said blade opening and said grate is pivotable about an axis of pivotation which is displaced from said blade;

d) an articulatable member pivotably secured to said header tube and being operably connected to said grate, said articulatable member being movable between a first position which corresponds to said first position of said grate and a second position which corresponds to said second position of said grate, and said articulatable member having a handle integrally formed with said grate and being offset at an angle therefrom by a first arcuate transition portion; and e) a thumb tab secured to said rearward facing surface of said blade and spaced apart from said header tube, said thumb tab configured to enable a user of said dredge head to grasp and manipulate said dredge head.

11. The dredge head of claim 10 wherein said axis of pivotation of said grate is displaced from said blade and a pivot pin is aligned tangential to said blade and perpendicular to said longitudinal central axis.

12. The dredge head of claim 11 wherein said axis of pivotation of said grate is displaced from said blade and said rearward facing surface of said blade faces said axis of pivotation.

13. The dredge head of claim 10 wherein a plurality of said thumb tabs are secured to said rearward facing surface of said blade and said plurality of thumb tabs are spaced apart from one another.

14. The dredge head of claim 10 wherein said axis of pivotation is perpendicular to an axis which extends through said aperture formed in said header tube, and said dredge head is constructed from a non-metallic material.

15. A dredging system comprising said dredge head of claim 14.

16. A dredge head comprising:

a) a blade having a reverse C-shaped, arcuate cross-sectional profile with a longitudinal central axis which extends lengthwise through said profile, said blade having a forward facing surface, a rearward facing surface, and a thickness therebetween, said blade having a blade opening and a channel opening both of which extend through said thickness, and said channel opening being positioned adjacent to said blade opening;

b) a header tube having a forward facing end, a rearward facing end, and an aperture which extends axially therethrough, said forward facing end interfacing with said rearward facing surface of said blade, said aperture being coaxially aligned with said blade opening and being positioned adjacent to said channel opening, and said header tube having a first lateral surface and a second lateral surface;

c) an elongate grate positioned adjacent to said first lateral surface of said header tube, extending completely across and beyond said blade opening, said elongate grate having an upper grate prong spaced apart from a lower grate prong and defining an elongate slot therebetween, said elongate grate having an end and being pivotably movable between a first position and a second position, and when said grate is in said first position, said upper grate prong, said lower grate prong and said elongated slot extends across and beyond said blade opening and said upper and lower grate prongs contact said forward facing surface of said blade and partially limits flow through said blade opening, and when said grate is in said second position, said upper grate prong, said lower grate prong and said elongated slot are aligned at an angle to said blade opening and said upper and lower grate prongs are less restrictive in limiting flow through said blade opening and said grate is pivotable about an axis of pivotation which is displaced from said blade; and d) an articulatable member pivotably secured to said header tube and being operably connected to said grate, said articulatable member being movable between first position which corresponds to said first position of said grate and a second position which corresponds to said second position of said grate, and said articulatable member having a handle integrally formed with said grate and being offset at an angle therefrom by a first arcuate transition portion wherein when said grate is in said first position, said end of said grate is positioned laterally beyond a straight-line projected from said second lateral surface of said header tube; and when said grate is in said second position, said end of said grate is positioned generally between a straight-line projected from said first lateral surface of said header tube and a straight-line projected from said second lateral surface of said header tube.

17. The dredge head of claim 16 wherein when said grate is in said second position, said end of said grate is positioned generally between a straight-line projected from said first lateral surface of said header tube and a straight-line projected from said second lateral surface of said header tube and proximate said first lateral surface of said header tube.

18. A dredging system comprising said dredge head of claim 16.

19. A dredge head comprising:

a) a blade having a reverse C-shaped, arcuate cross-sectional profile with a longitudinal central axis which extends lengthwise through said profile, said blade having a forward facing surface, a rearward facing surface, and a thickness therebetween, said blade having a blade opening and a channel opening both of which extend through said thickness, and said channel opening being positioned adjacent to said blade opening;

b) a header tube attached to said blade and having a forward facing end, a rearward facing end, and an aperture which extends axially therethrough said forward facing end being located proximate said blade and said rearward facing end being distal said blade, said blade interfacing with said rearward facing surface of said blade, and said aperture being coaxially aligned with said blade opening and being positioned adjacent to said channel opening;

c) a grate extending completely across and beyond said blade opening, said grate having an upper grate prong spaced apart from a lower grate prong and defining an elongate slot therebetween, said grate being pivotably movable between a first position and a second position, and when said grate is in first position, said upper grate prong, said lower grate prong and said elongated slot extends across and beyond said blade opening and said upper and lower grate prongs contact said forward facing surface of said blade and partially limits flow through said blade opening, and when grate is in said second position, said upper grate prong, said lower grate prong and said elongated slot are aligned at an angle to said blade opening and said upper and lower grate prongs are less restrictive in limiting flow through said blade opening and said grate is pivotable about an axis of pivotation and along an angle of pivotation having a magnitude of greater than about 50 degrees of pivoting travel;

d) an articulatable member pivotably secured to said header tube and being operably connected to said grate, said articulatable member being movable between a first position which corresponds to said first position of said grate and a second position which corresponds to said second position of said grate, and said articulatable member having a handle integrally formed with said grate and being offset at an angle therefrom by a first arcuate transition portion; and e) a thumb tab secured to said rearward facing surface of said blade and spaced apart from said header tube, said thumb tab configured to enable a user of said dredge head to grasp and manipulate said dredge head.

20. The dredge head of claim 19 wherein said grate is pivotable about an axis of pivotation and along an angle of pivotation having a magnitude of greater than about 60 degrees of pivoting travel.

21. The dredge head of claim 19 wherein said grate is pivotable about an axis of pivotation and along an angle of pivotation having a magnitude of greater than about 70 degrees of pivoting travel.

22. The dredge head of claim 19 wherein said grate is pivotable about an axis of pivotation and along an angle of pivotation having a magnitude of greater than about 80 degrees of pivoting travel.

23. The dredge head of claim 19 wherein said dredge head is constructed from non-metallic material and said header tube is void of any obstructions.

24. The dredge head of claim 20 wherein said dredge head is constructed from plastic.

25. The dredge head of claim 19 wherein said a plurality of said thumb tabs are secured to said rearward facing surface of said blade and said plurality of thumb tans are spaced apart from one another.

26. The dredge head of claim 19 wherein said blade opening and said channel opening are aligned parallel to one another, and said articulatable member passes through said channel opening.

27. A dredging system comprising said dredge head of claim 19.

* * * * *

UNITED STATES PATENT AND TRADEMARK OFFICE

CERTIFICATE OF CORRECTION

PATENT NO. : 7,552,551 B2
APPLICATION NO. : 11/302354
DATED : June 30, 2009
INVENTOR(S) : Richard J. Kohutko It is certified that error appears in the above-identified patent and that said Letters Patent is hereby corrected as shown below:

IN THE BACKGROUND:
In Column 1, Line 20, delete “the” after “into”.

IN THE SUMMERY:
In Column 4, Line 14, add a comma after “facing surface”.

In Column 4, Line 18, remove the period after “extends”.

In Column 4, Line 42, add a comma after “facing surface”.

IN THE DESCRIPTION OF THE ILLUSTRATED EMBODIMENTS:
In Column 11, Line 1, remove the “s” after “bolt heads” and add a comma.
[i.e., it should read, “184 is a bolt with a bolt head, a bolt shaft,...”]

In Column 11, Line 24, delete “20” and add “200”.

In Column 13, Line 29, add a period after “217”.

In Column 14, Line 23, add a period after “217”.

In Column 17, Line 33, add a comma after “first”
[i.e., it should read, “...generally defines first, second and...”]

In Column 17, Line 42, add quotations after “OA”.

UNITED STATES PATENT AND TRADEMARK OFFICE

CERTIFICATE OF CORRECTION

PATENT NO. : 7,552,551 B2
APPLICATION NO. : 11/302354
DATED : June 30, 2009
INVENTOR(S) : Richard J. Kohutko It is certified that error appears in the above-identified patent and that said Letters Patent is hereby corrected as shown below:

IN THE CLAIMS:
In Claim 25, Line 5, delete the word "tans" and replace with "tabs".

Signed and Sealed this

Third Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,552,551 B2
APPLICATION NO. : 11/302354
DATED : June 30, 2009
INVENTOR(S) : Richard J. Kohutko It is certified that error appears in the above-identified patent and that said Letters Patent is hereby corrected as shown below:

IN THE BACKGROUND:
In Column 1, Line 20, delete “the” after “into”.

IN THE SUMMARY:
In Column 4, Line 14, add a comma after “facing surface”.

In Column 4, Line 18, remove the period after “extends”.

In Column 4, Line 42, add a comma after “facing surface”.

IN THE DESCRIPTION OF THE ILLUSTRATED EMBODIMENTS:
In Column 11, Line 1, remove the “s” after “bolt heads” and add a comma.
[i.e., it should read, “184 is a bolt with a bolt head, a bolt shaft,...”]

In Column 11, Line 24, delete “20” and add “200”.

In Column 13, Line 29, add a period after “217”.

In Column 14, Line 23, add a period after “217”.

In Column 17, Line 33, add a comma after “first”
[i.e., it should read, “...generally defines first, second and...”]

In Column 17, Line 42, add quotations after “OA”.

UNITED STATES PATENT AND TRADEMARK OFFICE

CERTIFICATE OF CORRECTION

PATENT NO. : 7,552,551 B2
APPLICATION NO. : 11/302354
DATED : June 30, 2009
INVENTOR(S) : Richard J. Kohutko It is certified that error appears in the above-identified patent and that said Letters Patent is hereby corrected as shown below:

IN THE CLAIMS:
In Claim 25, Line 5, delete the word "tans" and replace with "tabs".

This certificate supersedes the Certificate of Correction issued November 3, 2009.

Signed and Sealed this

Twenty-fourth Day of November, 2009

David J. Kappos

David J. Kappos
*Director of the United States Patent and Trademark Office*